United States Patent [19]

Wathey

[11] Patent Number: 4,464,083

[45] Date of Patent: Aug. 7, 1984

[54] ICE GUARD FOR PROTECTING PILINGS

[76] Inventor: John G. Wathey, 2251 E. Country Club Pkwy., Toledo, Ohio 43614

[21] Appl. No.: 411,240

[22] Filed: Aug. 25, 1982

[51] Int. Cl.[3] ..... E02B 15/02; E02D 5/60

[52] U.S. Cl. ..... 405/216; 405/217; 405/61

[58] Field of Search ..... 405/61, 62, 211, 216, 405/217

[56] References Cited

U.S. PATENT DOCUMENTS

| | | | |
|---|---|---|---|
| Re. 28,332 | 2/1975 | Schirtzinger . | |
| 2,791,096 | 5/1957 | Morton et al. . | |
| 2,928,411 | 3/1960 | Johnson . | |
| 3,109,288 | 11/1963 | Gross | 405/61 |
| 3,170,299 | 2/1965 | Clarke | 405/61 |
| 3,180,099 | 4/1965 | Mikolajczyk et al. . | |
| 3,370,432 | 2/1968 | Butler et al. . | |
| 3,373,821 | 3/1968 | Sare | 405/61 X |
| 3,470,700 | 10/1969 | Quanie et al. | 405/211 |
| 4,019,301 | 4/1977 | Fox . | |
| 4,023,374 | 5/1977 | Colbert et al. . | |
| 4,114,388 | 9/1978 | Straub . | |
| 4,252,471 | 2/1981 | Straub . | |
| 4,300,855 | 11/1981 | Watson | 405/61 |

*Primary Examiner*—Cornelius J. Husar
*Assistant Examiner*—Nancy J. Stodola
*Attorney, Agent, or Firm*—Emch, Schaffer & Schaub

[57] ABSTRACT

The application discloses an ice guard for protecting a vertically extending piling positioned in a body of water from damage due to changes in water and ice levels. The ice guard is concentrically positioned around a piling and extends above the surface of the body of water. The ice guard is held in place by the surrounding ice. The ice guard includes at least one longitudinally extending sleeve which is made of a buoyant material and a means for restricting vertical movement of at least a portion of the sleeve. Various longitudinally extending ribs can radiate from the sleeve to enhance adhesion of the sleeve to the ice.

14 Claims, 5 Drawing Figures

FIG. 1
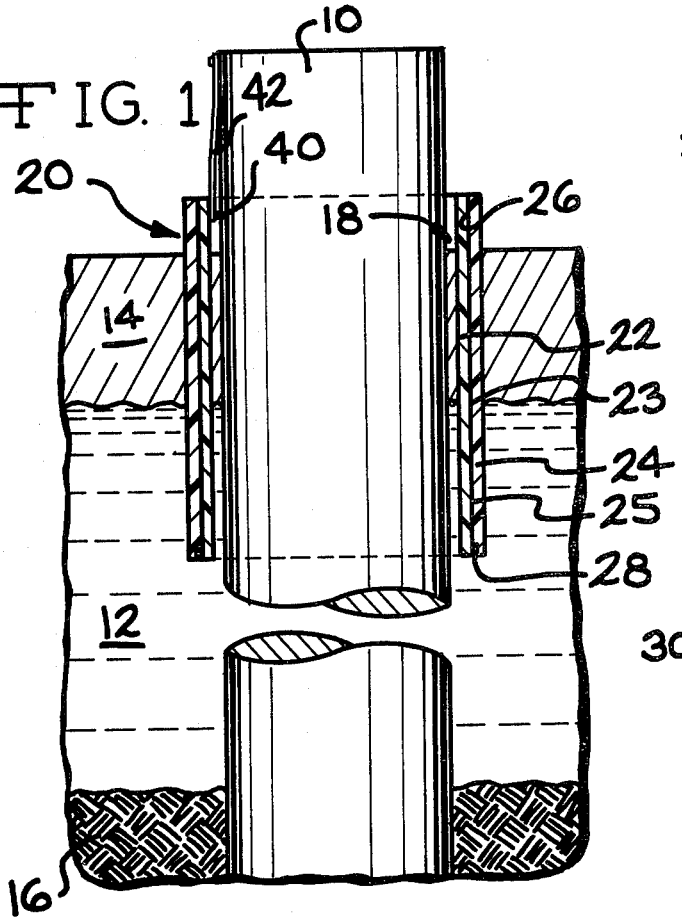
FIG. 2
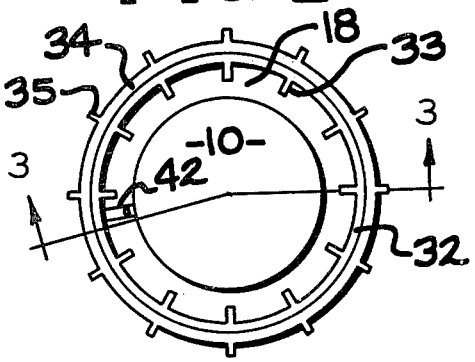
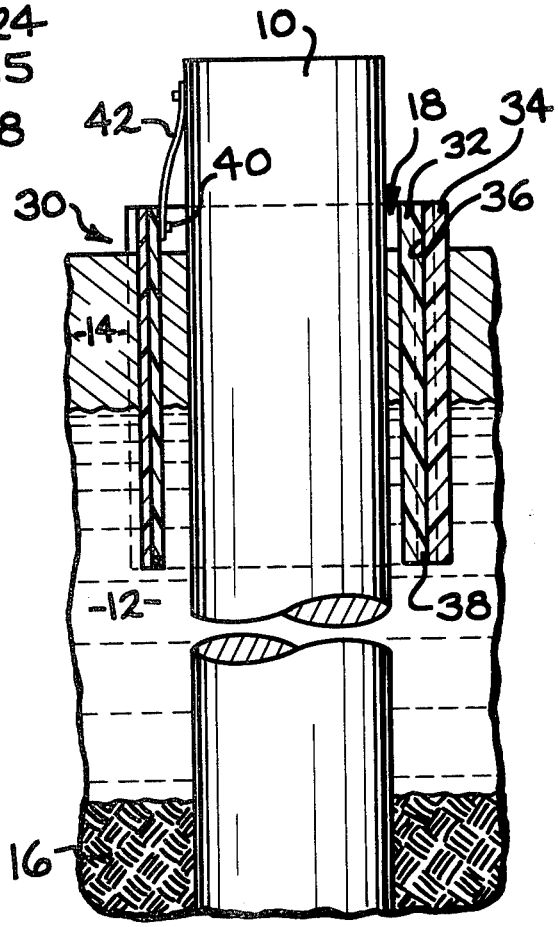
FIG. 5
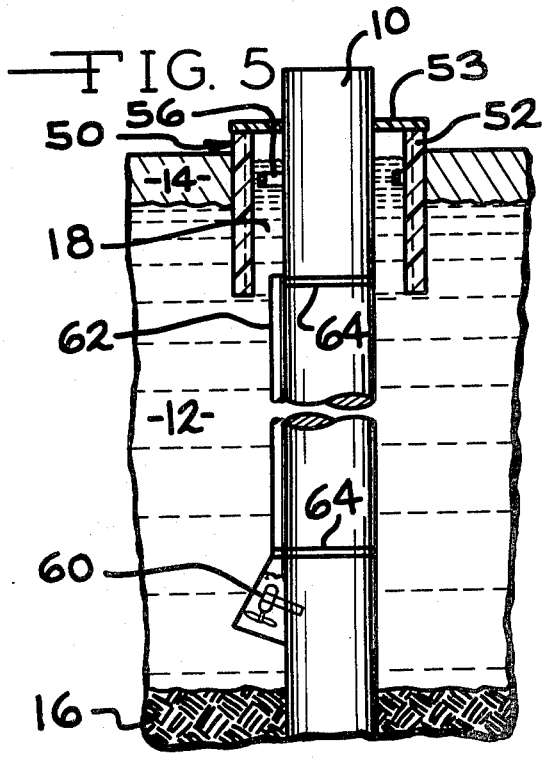
FIG. 3
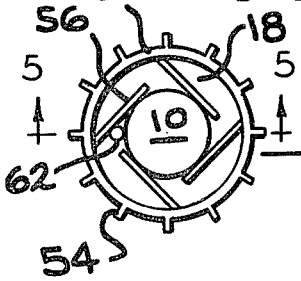
FIG. 4

ICE GUARD FOR PROTECTING PILINGS

BACKGROUND OF THE INVENTION

Damage to dock pilings is an annual problem in climates where bodies of water are subject to seasonal freezing. Since it is often cost prohibitive or impractical to remove the piling from the ground during these seasons, the pilings are left in place in the water. As a layer of ice covers the body of water the ice freezes to the pilings. The level of underlying water in such bodies usually does not remain constant, and the layer of ice necessarily rises or falls with the change in the water level. Since the pilings are firmly frozen to the ice, the force of the shifting ice causes the pilings to be loosened or pulled from the ground.

Prior attempts to solve this problem have been made. For example, Butler U.S. Pat. No. 3,370,432 shows a tubular collar which requires a layer of an anti-freeze solution surrounding the piling. Mikolajczyk U.S. Pat. No. 3,180,099 shows a sheath containing a brass spring and a lining which is positioned around a piling and attached to the bottom of the crossboards of a dock. However, when crossboards are removed for the winter season, this device cannot be used. In another example, Straub U.S. Pat. No. 4,252,471 shows a tapered cylinder which is permanently attached to a piling and does not float at the surface of the water.

SUMMARY OF THE INVENTION

The present invention is directed to an apparatus for protecting dock pilings which includes an ice guard which solves the above-identified problem. Even when the level of ice rises or falls for any reason, by using the present apparatus, the pilings remain firmly embedded in the ground.

The primary object of the present invention is to provide an improved ice guard system, including a protective sleeve which prevents the pilings from being removed from the ground during changes in ice levels.

BRIEF DESCRIPTION OF THE DRAWINGS

FIG. 1 is a view, partially in vertical cross-section, of an ice guard positioned on a piling according to the present invention.

FIG. 2 is a plan view of a second embodiment of the present invention.

FIG. 3 is a view, partially in vertical cross-section, taken along the line 3—3 in FIG. 2.

FIG. 4 is a plan view of a third embodiment of the present invention.

FIG. 5 is a view partially in vertical cross-section, taken along the line 5—5 in FIG. 4.

DESCRIPTION OF THE PREFERRED EMBODIMENT

The invention is directed to an ice guard for protecting pilings from damage. More particularly, the ice guard is constructed to prevent the upheaval of pilings from the ground by shifting ice and changing water levels.

Referring to the drawings, and to FIG. 1 in particular, the ice guard 20 is positioned coaxially around a conventional piling 10. The piling 10 extends through a layer of ice 14 of a body of water 12, and is embedded at its lower end in the ground 16. The ice guard 20 generally includes an inner sleeve 22 surrounded by an outer sleeve 24, a weight ring 28 mounted on the lower end of the sleeve 24 and a tab means 40 attached to the upper end of the sleeve 22 and the piling 10.

The ice guard 20 has a cross-section that is complimentary with the cross-section of the piling 10. The diameter of the inner sleeve 22 is sufficiently larger than the diameter of the piling 10 such that a tubular space 18 is formed. The inner sleeve 22 and the outer sleeve 24 are made of a buoyant plastic material such as a polyethylene or a polypropelene material. A buoyant foam plastic material such as polyethylene foam or polypropelene foam may be utilized. The inner sleeve 22 and the outer sleeve 24 are concentric and contiguous. The inner sleeve 22 has an exterior wall 23 with a relatively smooth surface. The outer sleeve 24 has an interior wall 25 with relatively smooth surface. The exterior wall 23 and the interior wall 25 have a relatively low coefficient of friction such that the inner sleeve 22 slideably mates with the outer sleeve 24. In another embodiment of the invention, as shown in FIG. 1, a layer of a low temperature water resistant lubricant material 26 can be placed between the inner sleeve 22 and the outer sleeve 24 to facilitate movement of the sleeves 22 and 24.

The weight ring 28 is placed at the lower end of the outer sleeve 24 to stabilize the ice guard 20 in a vertical position. The buoyancy of the ice guard 20 versus the weight ring 28 is so proportioned that the arrangements of FIGS. 1 and 3 will float approximately at surface of the water.

A tab means 40 is attached to the inner sleeve 22. A strap 42 connects the tab means 40 to the upper end of the piling 10. The tab means 40 and the strap 42 limit the extent to which the ice guard 20 may ascend or descend along the piling 10. The ice guard 20 can be made in any length insofar as the length is determined by the expected ice conditions, such as the tidal range in any geographical area or by the thickness of the ice formation. Also, if a different material is utilized for the sleeves 22 and 24, such as a vinyl material, it is understood that the weight ring 28 may be eliminated and the tab means 40 either eliminated or relocated.

In operation, the surface of the body of water 12 forms in an ice layer 14 and freezes against the exterior wall of the outer sleeve 24 causing the outer sleeve 24 to firmly adhere to the layer of ice 14. The ice layer 14 also forms in the tubular space 18. The ice formed in the tubular space 18 freezes to the piling 10 and the inner sleeve 22. Thus inner sleeve 22 is connected to the piling 10 by the ice in the tubular space 18 causing the sleeve 22 to remain in a stationary position.

A weak shear plane exists between the exterior wall 23 of the inner sleeve 22 and the interior wall 25 of the outer sleeve 24. As the level of water 12 changes, for any reason, the layer of ice 14 moves. As the layer of ice 14 shifts and heaves the outer sleeve 24 remains adhered to the ice 14 and moves relative to, or telescopes on, the inner sleeve 22. The exterior wall of the outer sleeve 24 and the interior wall of the inner sleeve 22 can have relatively rough surfaces such that there is an increased surface area to enhance the freezing of the ice 14 to the ice guard 20.

In another embodiment of the invention, as shown in FIGS. 2 and 3, the inner sleeve 32 has a plurality of longitudinally extending ribs 33 on the interior wall which radiate inwardly towards the piling 10. The ribs 33 provide an increased surface area to enhance freezing of the ice to the inner sleeve 32. The ribs 33 also provide structural reinforcement for the inner sleeve 32.

The outer sleeve 34 has a plurality of longitudinally extending ribs 35 on the exterior wall which radiate outwardly from the piling 10. The ribs 35 provide an increased surface area to enhance freezing of the ice 14 to the outer sleeve 34. The ribs 35 provide structural reinforcement for the outer sleeve 34. The exterior wall of the outer sleeve 34 and the interior wall of the inner sleeve 32 can have relatively rough surfaces. The rough surfaces increase the available surface area for adhesion of the ice to the sleeves 32 and 34 during freezing. A weight ring 38 is placed at the lower end of the inner sleeve 32 to stabilize the ice guard 30 in a vertical position. A tab means 40 and cable 42 are attached to the ice guard 30 to prevent easy removal of the ice guard 30 from the piling 10. The dimensions and number of ribs 33 and 35 on the sleeves 32 and 34 are dependent upon the expected ice conditions.

In another embodiment of the invention, as shown in FIGS. 4 and 5, a sleeve 52 has a plurality of longitudinally extending ribs 54 on the exterior wall which radiate outwardly from the piling 10. A plurality of spring arms 56 are located on the interior wall of the sleeve 52 and radiate inwardly toward the piling 10. The spring arms 56 are positioned at an acute angle to the interior wall of the sleeve 52. The arms 56 engage the piling 10 and hold the ice guard 50 firmly in a coaxial position against the piling 10.

A bubbler or propeller system 60, which is well-known in the art, is attached to the piling 10. A duct means 62 is attached to the bubbler system 60 and extends upwardly into the tubular space 18 between the piling 10 and the sleeve 52. The duct means 62 is attached to the piling 10 by means of conventional straps 64. The bubbler or propeller system 60 and the duct means 62 direct the warmer water near the bottom of the body of water 12 towards the surface. The mixture of air and warmer water in the tubular space 18 retards the formation of ice in the tubular space 18. An insulating cover 53 is placed over the top end of the sleeve 52 to additionally retard the formation of ice. The duct means 62 is constructed of an insulated material so as to reduce heat loss from the warmer water. The sleeve 52 is also perferably made of an insulated material to prevent heat loss.

In operation, the layer of ice 14 freezes against the exterior wall of the sleeve 52. Since warmer water is constantly being brought to the surface a strong ice formation does not occur between the interior wall of the sleeve 52 and the piling 10. As the water level changes, the layer of ice 14, with the sleeve 52 attached, ascends or descends along the piling 10.

The ice guards 20, 30, and 50 are shown to be cylindrical in shape but it will be understood that they need not be limited to any particular cross-sectional shape. The length of the ice guards 20, 30 and 50 can vary according to variations in water levels and ice layer depths. The length is a predetermined length in excess of the ice layer thickness.

The above-detailed description of the invention is given only for the sake of explanation. Various modifications and substitutions, other than those cited, can be made without departing from the scope of the invention as defined in the following claims.

I claim:

1. An ice guard for use on a vertically extending piling positioned in a body of water, the body of water having a layer of ice on its surface, said ice guard comprising, in combination, a longitudinally extending sleeve assembly having a cross-section complimentary with a cross-section of the piling, said sleeve assembly extending above the surface of the body of water, said sleeve assembly comprising telescoping inner and outer sleeves, said sleeves being movable vertically relative to one another, whereby upon freezing said inner sleeve is attached to the piling and said outer sleeve is attached to the ice layer of the body of water, and rib means on said sleeves to enhance adhesion of said sleeves to the ice.

2. An ice guard according to claim 1, including restricting means comprising a tab means on said sleeve and a cable attached to said tab means, said cable connecting said inner sleeve to said piling.

3. An ice guard according to claim 1, wherein said ice guard is made of a plastic material that has a low coefficient of friction.

4. An ice guard according to claim 1, wherein said ice guard is made of a polyethylene material.

5. An ice guard according to claim 1, wherein said sleeve has a length in excess of a thickness of the ice layer.

6. An ice guard according to claim 1, wherein said sleeve has a diameter greater than the diameter of said piling.

7. An ice guard according to claim 1, wherein said outer sleeve has an interior surface and said inner sleeve has an exterior surface, said interior surface of said outer sleeve and said exterior surface of said inner sleeve having a substantially low coefficient of friction, whereby said inner sleeve slideably mates with said outer sleeve.

8. An ice guard according to claim 1, wherein said outer sleeve has an exterior surface and said inner sleeve has an interior surface, said interior and exterior surfaces having a relatively rough texture, whereby said ice guard has an increased exposed surface area.

9. An ice guard according to claim 1, wherein a layer of a lubricant material is placed between said inner and outer sleeves.

10. An ice guard according to claim 1, wherein a weight ring in placed adjacent an end of said outer sleeve that is below the surface of said body of water.

11. An ice guard according to claim 1, wherein said outer sleeve has outwardly extending radial ribs, said ribs extending longitudinally along said outer sleeve, said ribs providing an increased surface area to enhance adhesion of said outer sleeve to the ice.

12. An ice guard according to claim 1, wherein said inner sleeve has inwardly projecting radial ribs, said ribs extending longitudinally along said inner sleeve, said ribs providing an increased surface area to enhance adhesion of said inner sleeve to the ice.

13. An ice guard according to claims 11 or 12, wherein said inwardly extending ribs and said outwardly extending ribs have relatively rough surfaces, said surfaces acting to increase said surface area available for adhesion during freezing of said sleeves to the ice.

14. An ice guard for use on a vertically extending piling positioned in a body of water having a layer of ice on its surface, said ice guard comprising, in combination, a longitudinally extending sleeve assembly, said sleeve assembly including inner and outer telescoping sleeves moveable vertically relative to one another, whereby upon freezing said inner sleeve is attached to the piling and said outer sleeve is attached to the layer of ice, said outer sleeve having outwardly extending ribs, said ribs extending longitudinally along said outer sleeve, said inner sleeve having inwardly projecting ribs, said ribs extending longitudinally along said inner sleeve, and means for restricting vertical movement of said inner sleeve.

* * * * *